US009649738B2

(12) United States Patent
Höglund

(10) Patent No.: US 9,649,738 B2
(45) Date of Patent: May 16, 2017

(54) ARRANGEMENT AND METHOD FOR GRINDING SPHERICAL PRODUCTS

(71) Applicant: OY KWH MIRKA AB, Jeppo (FI)

(72) Inventor: Göran Höglund, Jeppo (FI)

(73) Assignee: OY KWH MIRKA AB (FI)

( * ) Notice: Subject to any disclaimer, the term of this patent is extended or adjusted under 35 U.S.C. 154(b) by 189 days.

(21) Appl. No.: 14/647,905

(22) PCT Filed: Nov. 28, 2013

(86) PCT No.: PCT/FI2013/051116
§ 371 (c)(1),
(2) Date: May 28, 2015

(87) PCT Pub. No.: WO2014/083243
PCT Pub. Date: Jun. 5, 2014

(65) Prior Publication Data

US 2015/0298279 A1 Oct. 22, 2015

Related U.S. Application Data

(60) Provisional application No. 61/731,173, filed on Nov. 29, 2012.

(30) Foreign Application Priority Data

Nov. 30, 2012 (FI) ..... 20126257

(51) Int. Cl.
*B24B 55/10* (2006.01)
*B24B 11/06* (2006.01)
(Continued)

(52) U.S. Cl.
CPC ..... *B24B 11/06* (2013.01); *A63D 5/10* (2013.01); *B24B 1/00* (2013.01); *B24B 23/03* (2013.01);
(Continued)

(58) Field of Classification Search
CPC ..... B24B 1/00; B24B 23/03; B24B 27/0076; B24B 55/105; B24D 11/008; A63D 5/10
(Continued)

(56) References Cited

U.S. PATENT DOCUMENTS 828,894 A * 8/1906 Martin ..... B24B 7/17 451/262
2,405,344 A * 8/1946 Cloutier ..... A63B 45/00 15/21.2
(Continued)

FOREIGN PATENT DOCUMENTS

CN 1142405 2/1997
DE 3421020 12/1985
(Continued)

OTHER PUBLICATIONS

International Search Report for International Application No. PCT/FI2013/051116 dated Feb. 10, 2014.
(Continued)

*Primary Examiner* — George Nguyen
(74) *Attorney, Agent, or Firm* — Altera Law Group, LLC

(57) ABSTRACT

The present invention relates to a method and an arrangement for grinding spherical products (12), such as e.g. bowling balls, in particular. Such an arrangement comprises at least one grinding machine (1) having a spherically oscillating grinding movement. A fastening plate (6) fitted on the grinding machine has a spherically shaped bearing surface (7) and a grinding product (9) fitted on this, which through its slits (13) adopts a position with accuracy of shape on the spherically shaped surface. The grinding product (9) will form a contact surface (17) in the interface, in which the grinding product cooperates with the spherical product. This contact surface then adopts a radius of curvature arranged to substantially correspond to the radius (r) of the spherical product (12). The grinding is performed with a
(Continued)

spherically oscillating grinding movement, which is adapted to the radius of the spherical product and simultaneously coincides with the radius of curvature of the contact surface.

22 Claims, 6 Drawing Sheets

(51) Int. Cl.

| | |
|---|---|
| ***A63D 5/10*** | (2006.01) |
| ***B24B 23/03*** | (2006.01) |
| ***B24B 27/00*** | (2006.01) |
| ***B24D 11/00*** | (2006.01) |
| ***B24B 1/00*** | (2006.01) |

(52) U.S. Cl.
CPC ..... *B24B 27/0076* (2013.01); *B24B 55/105* (2013.01); *B24D 11/008* (2013.01)

(58) Field of Classification Search
USPC ..... 451/50
See application file for complete search history.

(56) References Cited

U.S. PATENT DOCUMENTS 3,024,578 A * 3/1962 Mushkin ..... B24B 11/10 451/268
3,110,987 A * 11/1963 Arneson ..... B24B 11/10 451/268
3,167,884 A * 2/1965 Thompson ..... B24B 11/10 451/121
3,609,918 A * 10/1971 Hillman ..... B24B 11/10 451/268
3,961,448 A * 6/1976 Akahane ..... B24B 11/02 451/268
3,971,164 A * 7/1976 Albin ..... B24B 11/02 451/283
5,299,394 A * 4/1994 Surdacki ..... B24B 27/0069 451/194
5,484,329 A * 1/1996 Engelbrektson ..... B24B 11/02 451/50
5,613,896 A * 3/1997 Haus ..... A63D 5/10 451/112
6,186,875 B1 2/2001 Cook et al.
6,761,622 B2 * 7/2004 Nam ..... B24B 27/0076 451/178
7,063,607 B2 * 6/2006 Sim ..... A63B 45/00 451/178
7,585,203 B1 * 9/2009 Shim ..... B24B 11/04 451/283
7,892,073 B1 * 2/2011 Smania ..... B24B 11/10 15/21.2
8,113,919 B2 * 2/2012 Shim ..... B24B 11/06 451/159
8,177,605 B2 * 5/2012 Shim ..... A63B 45/00 451/159
2005/0079808 A1 4/2005 Tiede et al.
2009/0124179 A1 5/2009 Hoglund

FOREIGN PATENT DOCUMENTS

| | | |
|---|---|---|
| DE | 4233728 | 4/1994 |
| DE | 29911103 | 1/2000 |
| EP | 1162032 | 12/2001 |
| EP | 2202029 | 6/2010 |
| JP | H03121759 | 5/1991 |
| WO | 03/015984 | 2/2003 |

OTHER PUBLICATIONS

Oriano, Mark; Polishing a Bowling Ball with a Modified Cook Sphere Machine. Youtube [online] Sep. 25, 2013; published Jun. 12, 2012; https://www.youtube.com/watch?v=xQwwojDrpQc as stated on web site, without verification : Published on Jun. 12, 2012 This video shows the Cook Sphere machine polishing a bowling ball to demonstrate how the modification I made to the machine affects bowling ball oscillation during the polishing process. To learn more about the mod go to the link.

* cited by examiner

ARRANGEMENT AND METHOD FOR GRINDING SPHERICAL PRODUCTS

FIELD OF THE INVENTION

The present invention relates to an arrangement according to the preamble of claim 1 for grinding spherical products.

The invention also relates to a method according to the preamble of claim 13 for grinding spherical products.

PRIOR ART

In the production of spherical products or of products having spherical surfaces, such as for example bowling balls, these are usually ground after the casting has been completed. During casting, a visible seam is produced in the surface of the ball at the joint of the mould sections, and it is desirable to grind out this in order to obtain a surface layer that is as flawless as possible. During this grinding operation, it is also possible to provide the surface layer of the ball with a desired structure, simultaneously with removal of mould release agents and material components that may have migrated in the wrong proportion to the surface layer.

Such grinding work is normally performed by means of a special grinding machine, which usually comprises three grinding units. U.S. Pat. No. 5,613,896 discloses an example of such a machine. The machine comprises grinding units positioned with their respective centre lines in substantially perpendicular orientation relative to the surface of the ball. The grinding units are preferably shaped as grinding cups having an annular grinding coating. The edge of the annular coating, which contacts the surface of the ball, has a substantially conical inclination corresponding to the average inclination formed by the surface of the ball in the mean diameter of the grinding annular surface.

The three grinding units are placed in a ring under the ball and the ball is rotated in the cup-like array formed jointly by the annular surfaces. The ball rotates simultaneously with the rotation of the grinding units. The grinding may be performed in steps with gradually decreasing fineness of grains of the grinding tools, while water can be added in order to facilitate the grinding process.

The grinding process obtained by means of a grinding machine as described above is elaborate without being particularly efficient, since the effective grinding bearing surface is reduced. For this reason, the ball must be rotated for a long period of time for the grinding to cover the entire surface of the ball.

The use of bowling balls constitutes a particular field of application for a grinding machine as described above. When used in bowling, the ball is subjected to wear by contact with the bowling alley and the ball return mechanism, and also to fouling and coating of the ball surface by contact with the surface coating of the bowling alley and floor wax. Such wear and fouling entails a reoccurring need for cleaning and structuring the surface of the bowling ball so as to allow improved grip of the bowling ball or friction between the bowling alley and the ball. Thorough cleaning and desired restructuration of the surface of the bowling ball require a relatively comprehensive grinding operation. This is often done by hand with a cloth and a cleaning agent, an abrasive polishing agent or a soft grinding product. Such a manual grinding process not only makes it difficult to decide whether it has provided a satisfactory even result over the entire surface of the ball, but it also entails the risk of causing form defects in the spherical surfaces of the ball. Grinding by means of a rotating tool frequently produces parallel grinding scratches within the same area. These scratches are difficult to remove in a subsequent grinding step or polishing. The resulting grinding pattern will have an uncontrolled orientation, which may affect the grip and rotation of the ball in an undesired and unsatisfactory manner. This, in turn, may affect the path of the ball, since the pattern lacks neutral orientation.

Problem to be Solved

The present invention allows to substantially the problems entailed by prior solutions to be avoided. In this context, the invention has the purpose of providing a grinding device that is easy to use and has high operational reliability. The new method described here allows very easy and efficient grinding and polishing of spherical products so as to obtain an even and neutral surface structure without orientation, while contributing in preserving the spherical geometry of the ball. This purpose is achieved in accordance with the invention by an arrangement for grinding spherical products in accordance with the invention as defined in the characterising features of claim 1. On the other hand, a method for grinding spherical products in accordance with the invention is defined in the characterising features of claim 13.

The subsequent dependent claims define suitable further developments and variants of the invention, which further enhance its design and function.

The device and the method described in the present invention yield a plurality of marked benefits compared to the prior art. Thus, it is possible to obtain a grinding result that is optimal in every respect by using an oscillating grinding machine with spherical oscillation, in which a clamping plate driven by the grinding machine can also be freely spinning, in constrained rotation or merely oscillating. Herewith, the bearing surface shaped in the grinding product, consisting of the clamping plate with its grinding product, is advantageously given a shape that is identical with the surface of the ball being ground.

The spherical oscillation and the advantageously rotating clamping plate used by the present grinding machine in the working of a surface to be ground substantially neutralises such friction between a ground product and a grinding surface that is generated in a conventional grinding machine and makes such a rotating grinding machine pull into different directions depending on the direction of inclination of the grinding machine.

An oscillating movement as utilised in the present invention provides a grinding pattern with neutral orientation. The grinding traces made by the grinding product in the grinding surface will cross each other in all directions, whereas conventional rotating grinding machines leave a grinding pattern with principally parallel grinding lines in the same direction. This is particularly undesired in the grinding of bowling balls, since the ball will then get grinding traces in one direction in some cases, and traces in another direction in another case, and this yields a ball that behaves in an unexpected manner.

Further advantages and details of the invention will be explained in more detail in the description below.

LIST OF FIGURES

The invention is described in more detail below with reference to the accompanying drawing, in which FIG. 1 shows a special embodiment of a grinding machine provided with a circular clamping plate and a grinding product attached to this;

Figure 9:
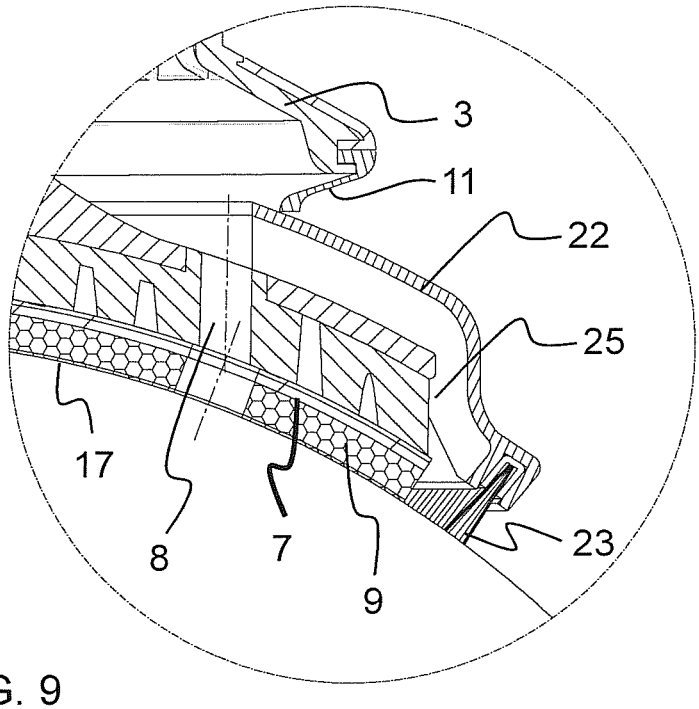
Figure 10:
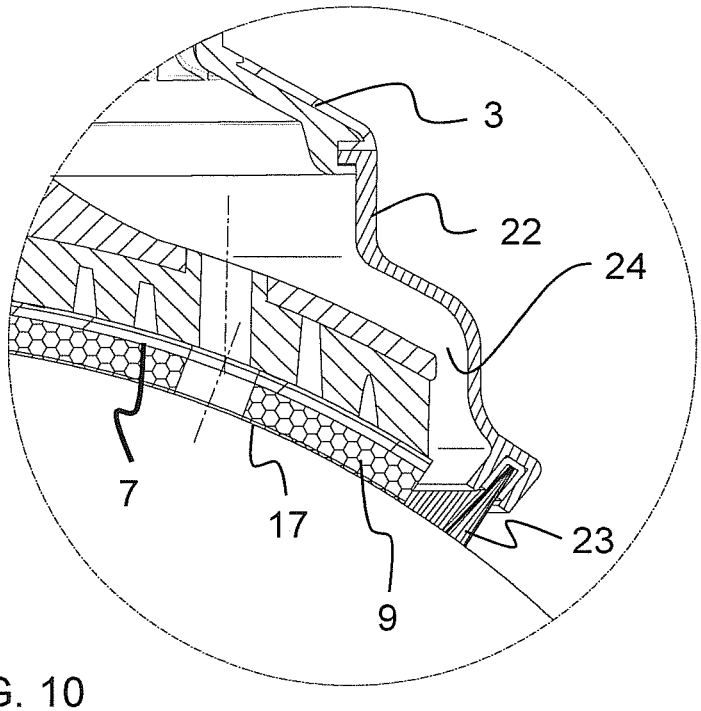
Figure 11:
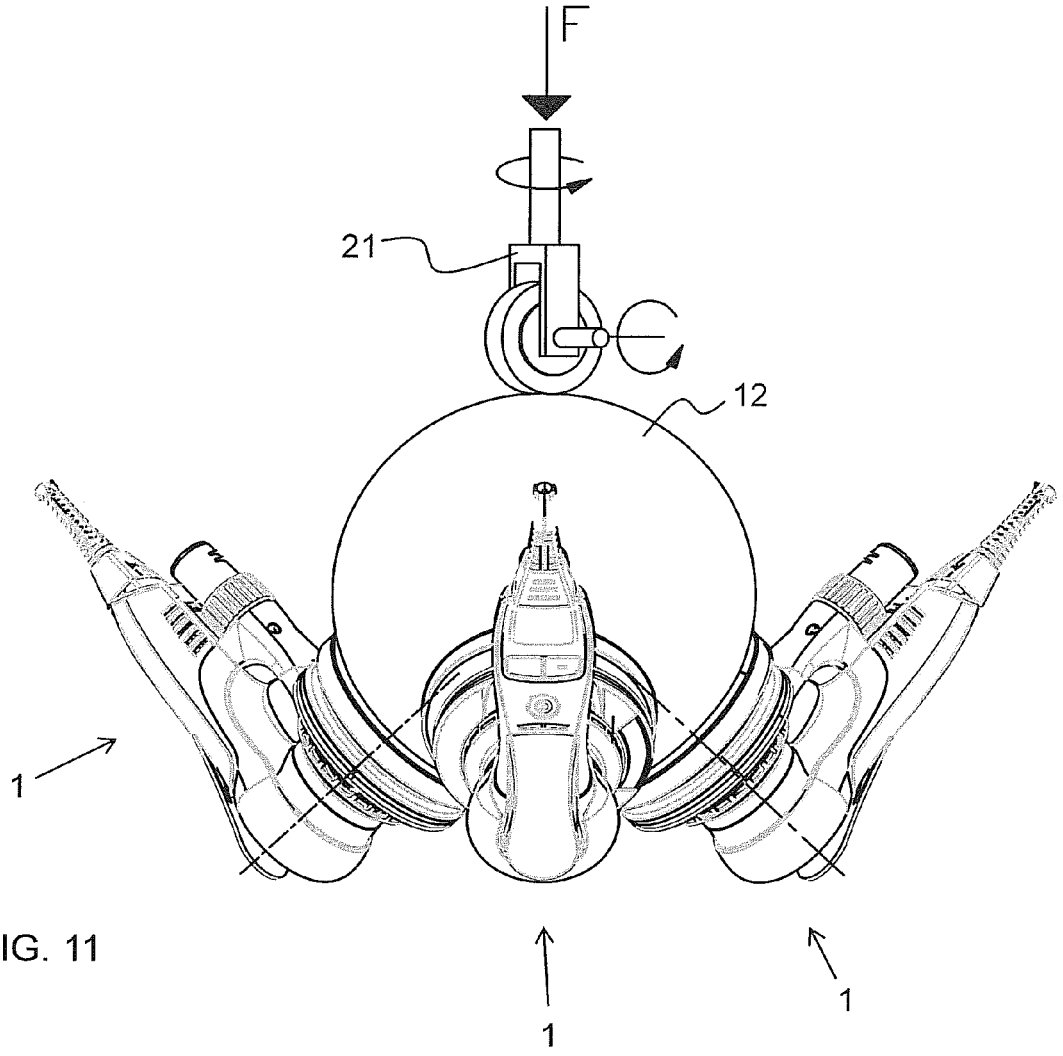
Figure 12:
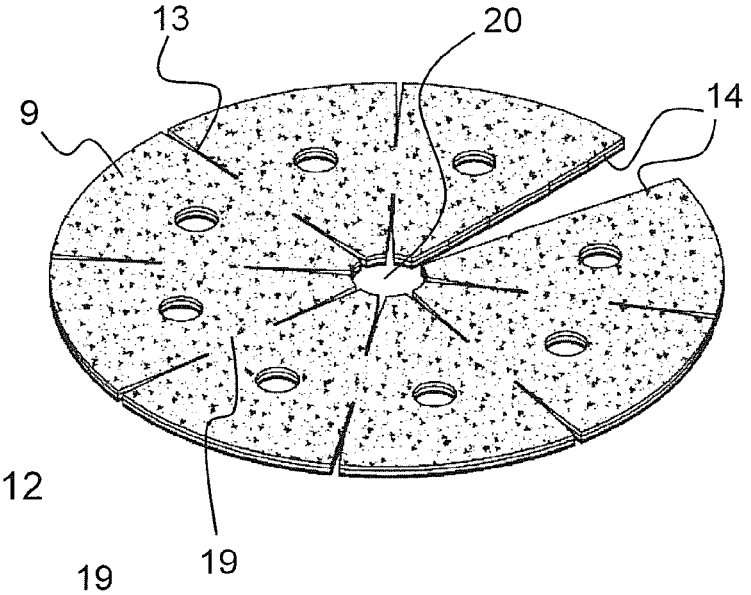
Figure 13:
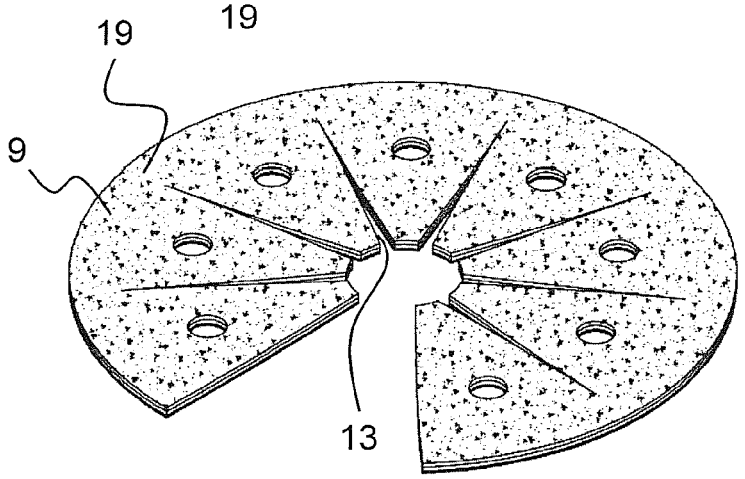
Figure 14:
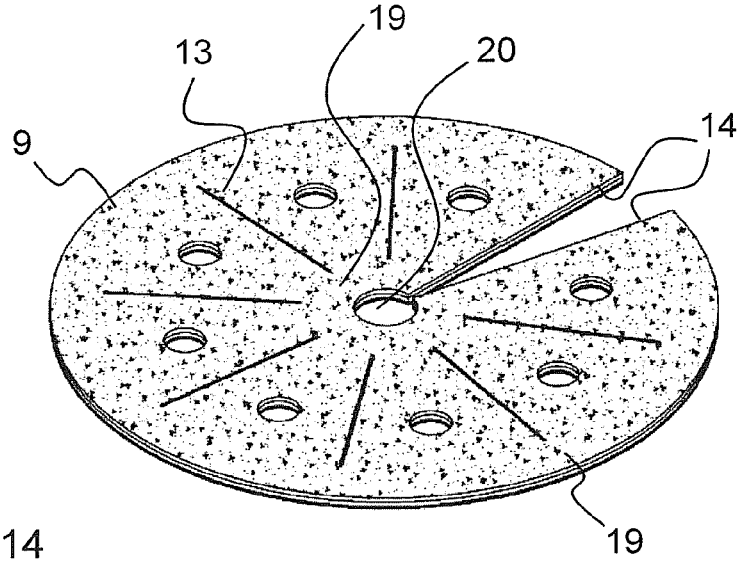

FIG. 9 shows an alternative detail of the edge of the clamping plate, its seal and a hood fitted on the clamping plate and having a brush ring, where a gap for exhaustion is built up by fins, which keep the hood at a suitable distance from the upper surface of the clamping plate, and the sealing sleeve seals against the upper spherical surface of the hood without any special adapter ring, FIG. 10 shows a further alternative detail of the edge of the clamping plate, its seal and of a stationary hood with a brush ring fitted on the grinding machine;

FIG. 11 shows a combination of three grinding machines for efficient grinding of a spherical product; and FIGS. 12 to 14 show alternative embodiments of the grinding product.

PREFERRED EMBODIMENTS

The figures mentioned above do not illustrate the arrangement for grinding spherical products to scale, their sole function being to illustrate the constructive solutions of the preferred embodiments and the function of the embodiments. The constructive parts shown in the figures and indicated with reference numerals correspond to the construction solutions presented in the description below.

Figure 1:
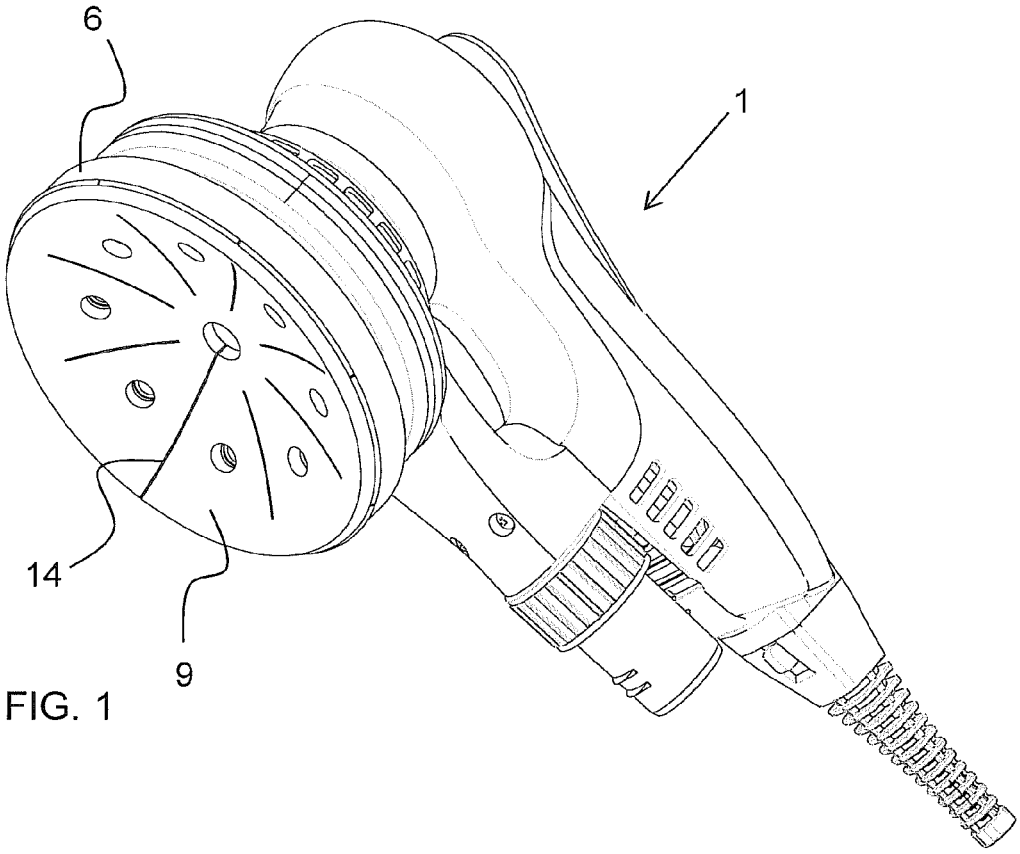
Figure 7:
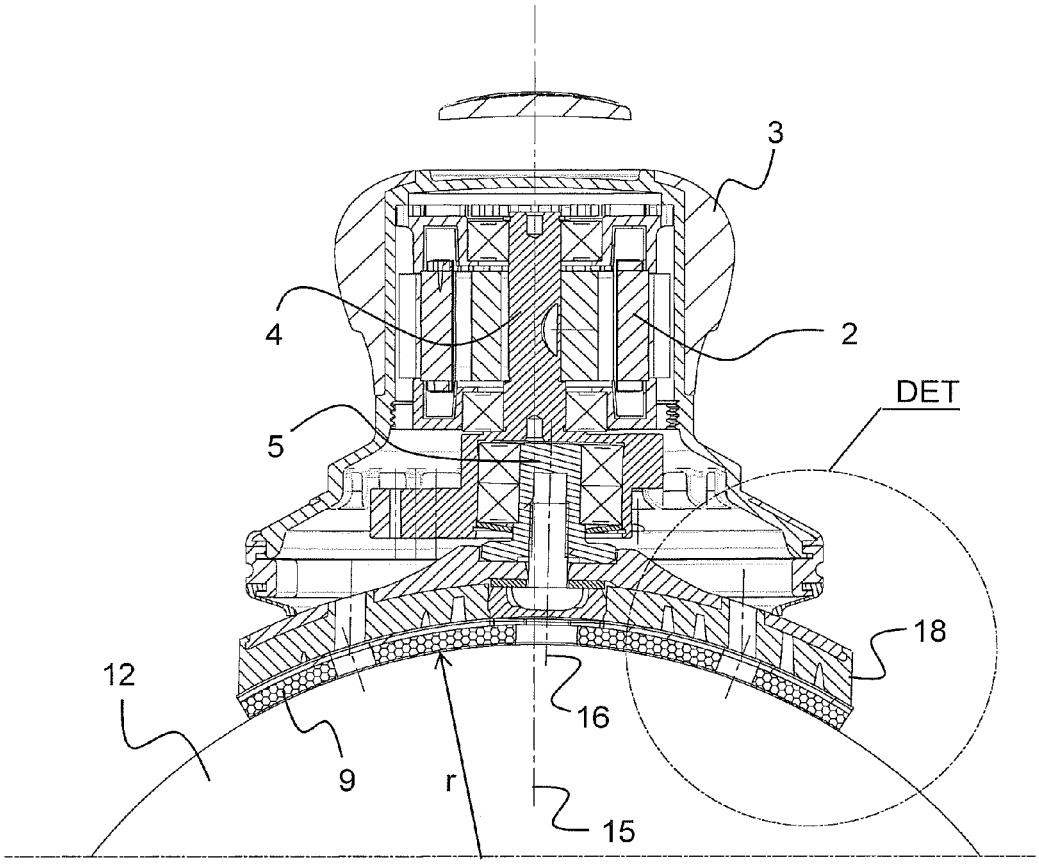
FIG. 7 shows a section through the drive shaft and clamping plate of the grinding machine, the angular fastening spindle of the grinding machine being visible and the clamping plate being eccentrically positioned relative to the grinding machine.

A preferred embodiment of the present grinding machine 1 comprises, in accordance with FIGS. 1 and 7, a drive motor 2 surrounded by a frame 3. The drive motor controls a drive shaft 4, which cooperates with a fastening spindle 5. Owing to its eccentric construction, the drive shaft will in a manner known per se define the spherically oscillating movement, with which the grinding machine carries out grinding. Said drive shaft may advantageously be arranged to be directly driven by the drive motor, as shown in accompanying FIG. 7. However, more conventional drive means are also applicable.

Figure 2:
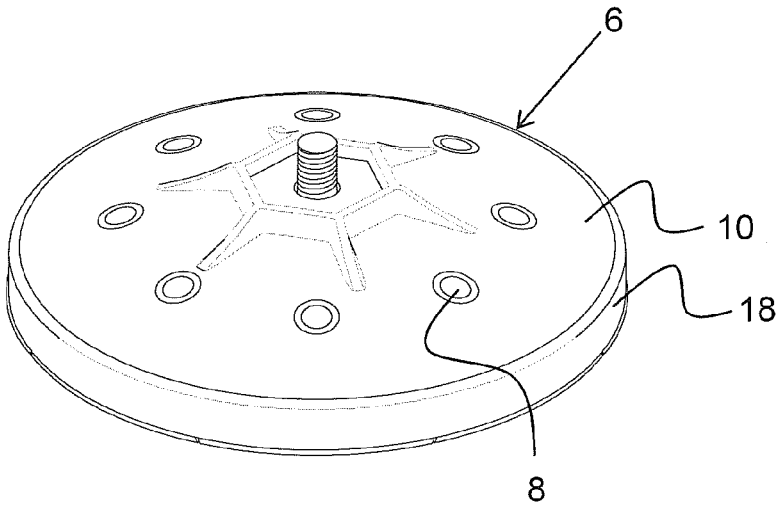
FIG. 2 shows a circular clamping plate in accordance with FIG. 1 viewed from above.
Figure 3:
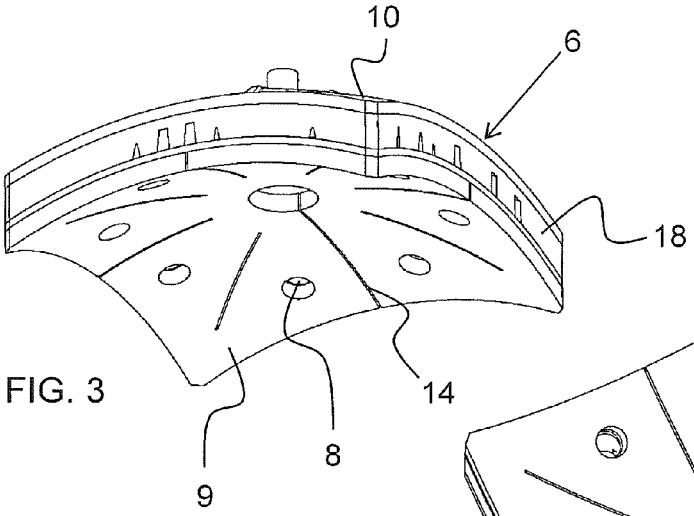
FIG. 3 shows an alternative square clamping plate viewed laterally.
Figure 4:
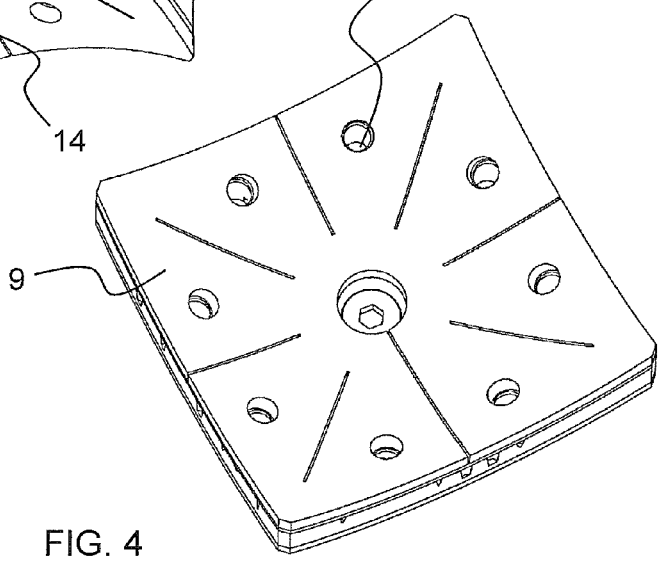
FIG. 4 shows a square clamping plate in accordance with FIG. 3 viewed from below.
Figure 5:
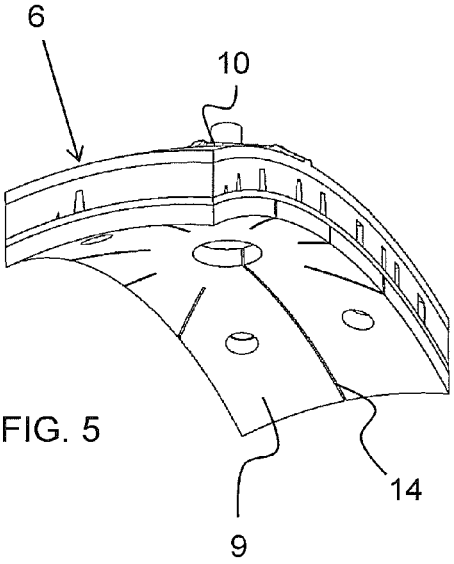
FIG. 5 shows an alternative rectangular clamping place viewed laterally.
Figure 6:
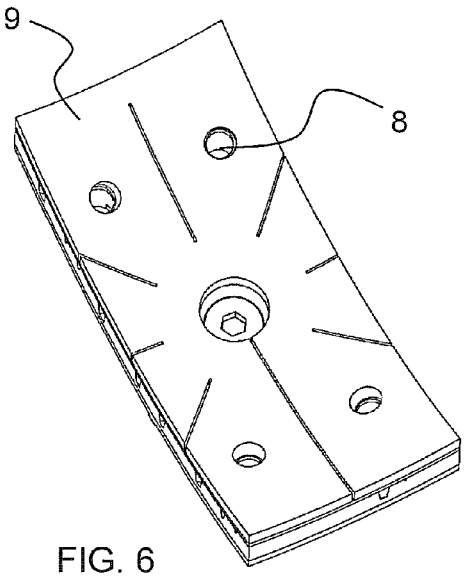
FIG. 6 shows a rectangular clamping plate in accordance with FIG. 5 viewed from below.
Figure 8:
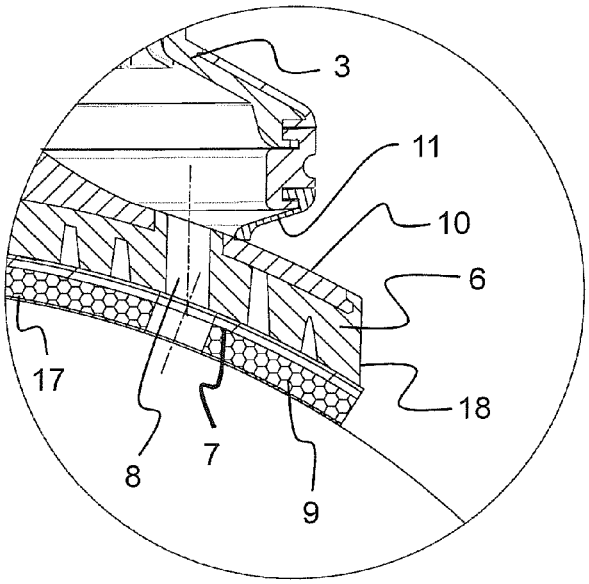
FIG. 8 shows in detail the edge, the upper surface portion and the seal for dust extraction of the clamping plate, encircled in FIG. 7.

The fastening spindle 5 is disposed to rotate freely relative to the eccentric portion of the drive shaft 4 and the frame 3 of the grinding machine 1 by disposing one or more bearing devices known per se between the drive shaft and the fastening spindle, the angle of the fastening spindle relative to the drive shaft providing a spherical oscillating movement. The fastening spindle, in turn, comprises a stationarily disposed clamping plate 6 having a hemispherical bearing surface 7 as shown in FIG. 8. The construction of the clamping plate may be hard or soft, circular as in FIGS. 1 and 2 or, for instance, quadrangular as in FIGS. 3 to 6. A square clamping plate preferably has a bearing surface shaped as a spherical surface. The hemispherical or spherical surface can be shaped both in the clamping plate itself and also by disposing an adapter on a plane clamping plate, the adapter forming the spherical bearing surface on the clamping plate.

The freely spinning clamping plate 6 involves random rotation, which is very easy to produce. One only has to mount the clamping plate on the fastening spindle 5 pivoted in the grinding machine 1, and then the movements of the fastening spindle will drive the clamping plate into rotation.

In one embodiment, in which the grinding machine 1 is provided with an oscillating clamping plate 6 with forced rotation, a gear will be required between the fastening spindle 5 and the drive shaft 4. Alternatively, such controlled rotation can be provided e.g. by means of gear transmission between the fastening spindle and the frame 3 of the grinding machine. For example, technical solutions known per se for plane oscillating grinding machines can be used.

Depending on the purpose of use, the drive motor 2 of the grinding machine can be electric or pneumatic. An electrically driven grinding machine 1 can be of mains a voltage type, of a low-voltage type with a transformer or of a battery-driven type with one or more rechargeable batteries.

The grinding machine 1 can advantageously be provided in a manner known per se with dust extraction through exhaustion apertures 8 comprised in the clamping plate 6 and a grinding product 9 disposed on this, cf. examples in FIG. 8. A clamping plate provided with such exhaustion apertures comprises a substantially spherical surface portion 10. This surface portion is formed at least in the place where a seal sleeve 11 comprised in the grinding machine is in contact with the clamping plate. In FIGS. 7 to 10, one can distinguish how the seal sleeve bears on the clamping plate with its surface opposite the bearing surface.

The clamping plate 6 of the grinding machine 1 must have a radius such that the grinding product 9, which is attached to the concavely shaped bearing surface 7 of the clamping plate, adopts a radius of curvature for the active contact surface of the grinding product that substantially corresponds to the radius r of the spherical surface or product 12 to be ground. This is the only way of fully utilising the spherical grinding movement adapted to the shape of the spherical surface or product. For this reason, it is important to form the fastening elements on the clamping plate and the grinding product attached to this with optimal accuracy of shape. This is solved e.g. by attaching the grinding product to the clamping plate comprised in the grinding head with fastening means known per se. Such means may consist of self-adhesive glue or Velcro fasteners.

It is, of course, possible to produce tailor-made fastening elements and grinding products 9 by stretching them against a mould and fixing them in the desired stretched spherical shape which corresponds to the bearing surface 7 of the clamping plate 6. However, a more rational solution is to use a plane and flexible material for the fastening surface and a corresponding plane and flexible grinding material of a standard type. In accordance with the embodiments shown in FIGS. 3 to 6 and 12 to 14, respectively, such a grinding product is provided with a minimum number of substantially radial slits 13 to allow optimal shaping of the final grinding product so that it can adequately adopt the spherical shape of the spherical surface or product 12.

The fundamental principle is to start by giving the grinding product 9 a substantially conical shape. With such a conical shape, the grinding product is optimised to fit in the hemispherical or spherical surface that the grinding tool, i.e. the clamping plate 6 and the grinding product 9 fitted on this, are intended to adopt. The conical basic shape is produced by cutting a sector from the grinding product, as shown in FIGS. 12 to 14. The sector is delimited by the edges 14 of the surface of the conical mantle, which result in a joint in the conically disposed mantle surface of the grinding product when the cone is being formed. This can be seen in FIGS. 1 and 3 to 6. This conical shape reduces the need to compensate for the three-dimensional bending of the surfaces by substantially radial slits 13, with which the grinding product has been additionally provided. The joint 14 of the mutually contacted edges of the grinding product also acts as one of the slits. The embodiment is illustrated e.g. in FIG. 1, where a grinding product 9 according to FIG. 14 has been arranged on the clamping plate 6.

The grinding product 9 may consist of a normal flexible grinding agent based on film, paper or textile, for example, and having a limited thickness. The grinding product may also consist of more voluminous products with a foam, non-woven or knitted base, for example. The grinding product may also be a combination of the examples above. When such thicker sandwich products are used, the substantial thickness of the grinding product has to be counteracted in the system by the oscillation centre and the radius of the bearing surface 7 of the clamping plate 6. In the present case, the oscillation centre coincides with the imagined point, where the centre line 15 of the drive shaft 4 of the grinding machine 1 and the centre line 16 of the fastening spindle 5 of the oscillating clamping plate meet and is identical with the centre of the ground sphere.

The grinding product 9 that is fastened on the concave bearing surface 7 of the clamping plate 6 will form a concave contact surface 17 in the interface between the grinding surface 9 and the spherical product 12, with which the grinding product is in interaction. In order to achieve the optimal grinding result, this contact surface is thus allowed to adopt a radius of curvature that corresponds substantially to the radius r of the spherical product to be ground. At the same time, the radius of the spherically oscillating movement is arranged to correspond to the radius of the spherical product to be ground. Consequently, the radius of curvature of the contact surface will also coincide with both the radius of the spherically oscillating movement and the radius r of the spherical product.

The grinding product 9 may naturally also consist of a polishing disc, to which a polishing agent in the form of polishing paste is applied in a manner known per se.

Since different grinding products 9 have varying thicknesses, it is advantageous to use a clamping plate 6 with a constant shape and thickness and to compensate for the differences in the thickness of different grinding products with a padding layer, called an intermediate pad, which is placed between the clamping plate and the grinding product whenever necessary. It is, of course, possible to produce clamping plates having different thicknesses adapted to the grinding product concerned, in order to yield the optimal grinding result in this manner.

The diameter of the periphery 18 of the clamping plate 6 may advantageously vary in terms of the standard sizes of grinding rounds. Thus, the diameter of the clamping plate may vary from 77 mm to 200 mm depending on the type of spheres or surfaces to be ground. In the grinding of bowling balls, the diameter is appropriately 120 mm.

The advantage of a clamping plate 6 having a smaller diameter of periphery 18 is that the grinding product 9 can be given a more straightforward shape. The larger the diameter of the clamping plate, the more complicated the cutting of the grinding product, since it needs to be provided with slits 13 to compensate for the three-dimensional bending of the clamping plate.

By placing the substantially radial slits 13 of the grinding product 9 and the joining bridges 19 comprised in the grinding product between the parts separated by the slits in different manners, it is further possible to optimise the fitting to the spherical bearing surface 7 of the clamping plate 6. Consequently, the slits can be given a uniform shape or a divided shape. FIG. 12 shows an embodiment with slits 13 divided into two parts and with bridges 19 between the parts. Hereby, the slits have a sector-like shape, with the sectors opening both towards the periphery of the grinding product and towards its centre. FIG. 13 shows an embodiment with uniform slits 13. These slits have a sector-like shape, so that the sector opens towards the centre of the grinding product and the bridges are located towards the periphery of the grinding product. FIG. 14 shows an embodiment with uniform slits 13 delimited by bridges both towards the periphery of the grinding product and its centre.

Tests have shown that, for a clamping plate 6 with a diameter less than 135 mm, it will be sufficient to provide the grinding product 9 with seven substantially radial additional slits 13 in order to achieve satisfactory three-dimensional fitting. Especially by providing the grinding product with a hole 20 in the centre, the fitting is markedly facilitated without any significant loss of the effective grinding material surface. The hole can appropriately have a diameter of 5 mm to 50 mm.

The larger the clamping plate 6 used in the grinding, the higher accuracy of shape is ensured in use. However, a larger clamping plate will involve decreased vertical grinding pressure towards the periphery 18 of the clamping plate. As a result of this, a clamping plate that covers up to half of the surface of the sphere will become uninteresting for use in the grinding, since the vertical component of the grinding pressure will be substantially equal to 0 in the periphery of the clamping plate. Due to the lack of grinding pressure in the outer region of the clamping plate, the use of large clamping plates becomes uninteresting, even though its grinding movement follows the surface of a sphere perfectly well even in this extreme position.

When grinding is performed using the present clamping plate 6, which is spherically oscillating and advantageously also rotating, the oscillation movement yields a grinding pattern that is broken in all directions, since each individual grinding grain in the contact surface 17 of the grinding product 9 describes a circular movement and performs grinding in all directions. Each grinding scratch produced by a grinding grain will then be ring-shaped and transformed into a spiral when the grinding machine with its clamping plate 6 is passed over the surface of the spherical product 12. Each spiral produced by the adjacent grinding grains will additionally during its movement intersect with the others several times for each oscillation. In addition, the dense grinding pattern will constantly overlap itself as the grinding tool rotates. The spherical oscillation now makes it possible to avoid parallel grinding scratches, which used to cause a problem, and also uncontrolled effects of these on the grip and the rotation of a bowling ball.

Any minor defects of form in the grinding tool formed jointly by the clamping plate 6 and the grinding product 9 are counteracted by the exact geometrical movement obtained with the spherically oscillating rotation. As a result, each point of the surface of the spherical product 12 will become more evenly ground and the geometry of the product will be better maintained or even improved if cutting is done to a larger extent.

The oscillation of the grinding tool not only leads to an even grinding result, but also allows eliminating the problems of the grinding machine 1 pulling itself into different directions, thus leading to unstable handling. A prior art grinding machine that merely rotates yields wobbly grinding, since the grinding machine pulls itself into different directions, depending on which side of the clamping plate is more loaded and thus engages the grinding surface. By contrast, in the present solution, the oscillation of the grinding tool compensates for these instability forces. Since the direction of the grinding force changes continuously and very rapidly due to the oscillation, the friction of the grinding machine seems almost neutralised. Instead of pulling into different directions when passed over the surface of the product, the grinding machine is centered towards the grinding centre by the oscillation combined with the rotation, and it will thus bear firmly against the hemispherical grinding surface.

The advantages yielded by the spherical oscillation can also be utilised with a grinding machine 1, in which the clamping plate 6 does not rotate, but its rotation is controlled by the clamping plate oscillating only spherically. This type of oscillation is produced by fastening the clamping plate flexibly in a manner known per se to the frame 3 of the grinding machine, the fastening of the clamping plate allowing the oscillating movement, while simultaneously preventing rotation of the clamping plate. Consequently, the clamping plate will substantially maintain its orientation relative to the grinding machine while oscillating.

In this case, the clamping plate 6 and the grinding product can be given shapes other than circular. For instance, they can be given an oval shape, a square shape or a rectangular shape, while having still a concave contact surface corresponding to the surface to be ground. Examples of these embodiments are illustrated in FIGS. 3 to 6. Grinding performed by means of such preferably square grinding products and a merely spherically oscillating movement makes it possible to perform efficient grinding along various edge and border lines, since the quadrangular shape of the grinding product provides a large effective grinding surface. Examples of suitable ground objects are helmets with folds, shifts of plane, support crests or ribs on the spherical surface. Narrow bands or other similar elongated spherical surfaces can also be worked by means of such specially formed grinding products. In this case as well, the same principle of a conical basic shape can be applied in order to facilitate the spherical bending required by the material of the grinding product.

In order to achieve efficient grinding and a grinding result with accuracy of shape, it is possible, instead of performing manual grinding with a handheld grinding machine 1, to use two or more grinding machines with a similar design, which are disposed to perform simultaneous grinding over the surface of a spherical product 12. The grinding machines can naturally be replaced with separate grinding units each provided with a separate frame, or they can be integrated in a common frame. Such grinding units can be controlled by individual control units, or they can be provided with a common control unit, which controls the function of each grinding unit.

The grinding machines 1 are advantageously positioned with the central axis of the oscillating movement perpendicular to the surface of the spherical product 12 and directed through the centre of the product. For this purpose, the grinding machines can be disposed in a special stand, where the clamping plate 6 is oriented upwards so as to form a cradle, in which the spherical product can be placed. The stand may, for instance, comprise fasteners, in which the grinding machines are pivoted relative to the frame of the stand. Owing to this pivoting, the central axis of the oscillating movement can be oriented perpendicularly to the surface of the spherical product and directed through the centre of the product with a view to the optimal grinding result. The grinding machines can, of course, be replaced with the special grinding units above, which are irremovably attached to the stand. The grinding machines can also be fastened or pivoted in a common frame, so that they in a manner known per se set automatically against the surface of the sphere to be ground. In this case as well, the contact is more exact, since the grinding force of the machines has a neutral direction and does not generate lateral forces.

The device described above appropriately comprises three grinding machines 1, or grinding units, disposed in a triangular mutual array, thus forming a cradle, in which the spherical product is placed as shown in FIG. 11. Owing to the gravitation affecting the spherical product 12, it can be ground under the effect of its own weight alone. The spherical product can then be brought into self-rotation and twist in this cradle e.g. by rotating one of the machines in a direction opposite to the others. The spherical product can also be brought into self-rotation by inclining at least two of the grinding machines in mutually different angles relative to the common vertical line of the system.

Owing to the fact that the position of the grinding machines of this device can be fine adjusted along the central axis 15 of the drive shaft, a relatively small clamping plate 6 and a grinding product 9 fitted on this yield the same benefits of accuracy of shape as a larger clamping plate.

A device as described above can also be provided with a special device 21 which rotates and twists the spherical product 12 while simultaneously pressing the product with a desired force F against the grinding tool of the grinding machines. This is schematically illustrated in FIG. 11. The grinding machines 1 can also be arranged to be inclined in different tilted positions in order to control the rotation of the spherical product during the grinding.

Since the spherical product 12 to be ground has a continuously bent surface with the same radius of curvature r in all directions, it is expedient to provide the grinding machine 1 with a hood 22 or a skirt that covers the clamping plate 6 and the attached grinding product 9 and joins the surface of the spherical product to be ground outside the periphery 18 of the clamping plate. At the same time, however, the clamping plate is allowed to oscillate within the hood or the skirt. The hood or the skirt is then connected to the clamping plate as shown in FIG. 9 or to the grinding machine as shown in FIG. 10. Such a hood or skirt may appropriately comprise an annular brush 23 as shown in FIGS. 9 and 10. The brush is advantageously disposed as a termination on the edge of the hood or the skirt against the surface to be ground. In this manner, the brush trails against the surface of the product and seals the surface appropriately, while allowing air intake in an appropriate amount in order to ensure adequate dust transport. This is solved in the case illustrated in FIG. 9, for instance, by building up an exhaustion gap 24 with fins 25, which keep the hood at a suitable distance from the surface portion 10 of the clamping plate, the sealing sleeve 11 for dust exhaustion sealing the hood without any separate adapter ring.

The annular brush 23 also has a cleaning effect when trailing against the surface of the spherical product 12 during air intake. This arrangement allows the dust problems of the grinding machine 1 to be substantially reduced.

The annular brush 23, which is shown in FIG. 10 and is stationarily mounted in the frame of the grinding machine, can also be disposed to rotate by means of a drive mechanism in order to enhance the cleaning effect of the surface that has been ground. The brush can both rotate and oscillate e.g. by the ring having an asymmetrical position or a slightly asymmetrical shape relative to the clamping plate, while being allowed to rotate about a symmetrically placed axis.

The grinding can also be performed as wet grinding, and then the dust is efficiently fixed and the grinding process is facilitated by the lubricating effect of the grinding liquid.

The description above and the figures referred to in the description are merely intended to illustrate the present solution for devising an arrangement for grinding spherical products and its application. Thus, the solution is not restricted exclusively to the embodiment described above or in the accompanying claims, but a plurality of variations or alternative embodiments are possible within the idea described in the accompanying claims.

The invention claimed is:

1. An handheld arrangement for grinding spherical products, the arrangement comprising at least one grinding machine provided with a drive motor surrounded by a frame;

an eccentrically constructed drive shaft controlled by the drive motor and disposed to cooperate with a fastening spindle whereby, the fastening spindle is set in an angle relative to the drive shaft providing a spherical oscillating movement, such that an oscillation center of the fastening spindle coincides with the imagined point, where a center line of the drive shaft and the center line of the fastening spindle meet and such a meeting point is to be identical with the center of the spherical product to be grinded, the grinding product being fitted on the bearing surface hereby adopting a position with accuracy of shape on the surface of the clamping plate, so that the grinding product forms a contact surface in the interface in which the grinding product cooperates with the spherical product to be grinded;

the contact surface having an adoptable radius of curvature; and said radius of curvature coinciding simultaneously with the radius of the spherically oscillating movement and the radius (r) of the spherical product.

2. An arrangement as claimed in claim 1, whereby in that the clamping plate has a controlled rotation relative to the drive shaft.

3. An arrangement as claimed in claim 2, whereby in that the clamping plate is disposed to rotate by force.

4. An arrangement as claimed in claim 2, whereby in that the clamping plate is attached to the frame of the grinding machine such that, an oscillating movement thereof is allowed, while a rotation of the clamping plate simultaneously is to be prevented, the clamping plate being arranged to substantially maintain its orientation relative to the grinding machine while oscillating.

5. An arrangement as claimed in claim 4, whereby in that the clamping plate has a principally circular extension.

6. An arrangement as claimed in claim 4, whereby in that the clamping plate has a principally square or rectangular extension.

7. An arrangement as claimed in claim 1, whereby in that the grinding product fitted on the bearing surface is disposed to adopt its position with accuracy of shape on the clamping plate through a conical basic shape, which has been produced with a sector that is cut from the surface of the conical mantle and is delimited by edges and with slits comprised in the grinding product.

8. An arrangement as claimed in claim 1, whereby in that the grinding machine comprises dust extraction through exhaustion apertures comprised in the clamping plate and the grinding product fitted on this.

9. An arrangement as claimed in claim 8, whereby in that the grinding machine comprises a seal sleeve disposed to be in contact with a substantially spherical surface portion of the clamping plate.

10. An arrangement as claimed in claim 1, whereby in that the grinding machine comprises a hood covering the clamping plate and the grinding product fitted on this and joining the surface of the spherical product to be ground outside the periphery of the clamping plate.

11. An arrangement as claimed in claim 10, whereby in that the hood comprises an annular brush as a termination on its edge towards the surface to be ground.

12. A method for grinding spherical products by means of at least one handheld grinding machine having a drive motor surrounded by a frame, whereby the drive motor controls a eccentrically constructed drive shaft, which cooperates with a fastening spindle, the fastening spindle is set in an angle relative to the drive shaft thus providing a spherical oscillating movement of the spindle, hereby an oscillation center of the fastening spindle is set to coincide with the imagined point, where a center line of the drive shaft and the center line of the fastening spindle meet, while this meeting point is to be identical with the center of the spherical product to be grinded, the fastening spindle is provided with a clamping plate, the clamping plate is formed to comprise a concave bearing surface, a grinding product being formed and fitted on the fastening plate, and the grinding product adopting a position with accuracy of shape on the concavely shaped surface of the clamping plate, so that the grinding product forms a contact surface in the interface, in which the grinding product cooperates with the spherical product, the contact surface adopting a radius of curvature arranged to substantially correspond to the radius (r) of the spherical product against which it is placed, and the grinding is performed with a spherically oscillating grinding movement, whose radius is adapted to the radius (r) of the spherical product and simultaneously coincides with the radius of curvature of the contact surface.

13. A method as claimed in claim 12, whereby in that the clamping plate adopts a controlled rotation relative to the drive shaft.

14. A method as claimed in claim 13, whereby in that the clamping plate is disposed to adopt an oscillating movement rotating by force.

15. A method as claimed in claim 13, whereby in that the clamping plate is attached to the frame of the grinding machine, allowing an oscillating movement thereof, while simultaneously preventing a rotation of the clamping plate, the clamping plate being arranged to substantially maintain its orientation relative to the grinding machine while oscillating.

16. A method as claimed in claim 14, whereby in that the grinding is performed by means of a clamping plate having a concave bearing surface and a circular shape and also with a grinding product adapted to this.

17. A method as claimed in claim 14, whereby in that the grinding is performed by means of a clamping plate having a concave bearing surface and a square or rectangular shape and also with a grinding product adapted to this.

18. A method as claimed in claim 12, whereby in that the grinding product is provided with a conical basic shape with slits by cutting a sector between the edges of the surface of the conical mantle and is arranged in a substantially conical position on the clamping plate and is thus made to adopt a position with accuracy of shape on its concave surface.

19. A method as claimed in claim 12, whereby in that two or more grinding machines are simultaneously directed substantially perpendicularly to the surface of the spherical product for each of them to interact in the grinding.

20. A method as claimed in claim 19, whereby in that the spherical product is arranged to bear with its own weight against the grinding machines and is brought into self-rotation by means of differences in the mutual direction of rotation of at least two grinding machines.

21. A method as claimed in claim 19, whereby in that the spherical product is arranged to bear with its own weight against the grinding machines and is brought into self-rotation by inclining at least two grinding machines in mutually different angles relative to the vertical line of the system.

22. A method as claimed in claim 12, whereby in that the grinding machine is provided with a device that presses the spherical product with a desired force F against the grinding product and simultaneously rotates and twists the product to ensure adequate grinding over its entire surface.

* * * * *